US008418389B1

(12) United States Patent
Lukman et al.

(10) Patent No.: US 8,418,389 B1
(45) Date of Patent: Apr. 16, 2013

(54) RECOIL REDUCTION APPARATUS AND METHOD FOR WEAPON

(75) Inventors: Hansen Lukman, Parsippany, NJ (US); James R. Connolly, Bloomfield, NJ (US); Kevin Russell, Jersey City, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 129 days.

(21) Appl. No.: 13/165,192

(22) Filed: Jun. 21, 2011

(51) Int. Cl.
*F41A 5/10* (2006.01)

(52) U.S. Cl.
USPC ..... 42/1.06; 89/77; 89/198

(58) Field of Classification Search ..... 42/1.06; 89/177, 178, 44.01, 193
See application file for complete search history.

(56) References Cited

U.S. PATENT DOCUMENTS 3,561,319 A * 2/1971 Joyce ..... 89/7
3,951,038 A * 4/1976 Van Langenhoven ..... 89/7

* cited by examiner

*Primary Examiner* — Stephen M Johnson
(74) *Attorney, Agent, or Firm* — Michael C. Sachs

(57) ABSTRACT

A recoil-reducing weapon may include a housing and a receiver translatably disposed in the housing. A barrel may have one end fixed to the receiver and be translatable with respect to the housing. A spring stop may be fixed to the barrel forward of the housing and a spring may be disposed between the spring stop and a front of the housing. An operating group with a gear rack may be translatably disposed in the receiver. A longitudinal member may have one end fixed to the operating group. A counter-mass may have a second gear rack and an opening therein for receiving the longitudinal member. A second spring may be disposed around the longitudinal member. One end of the second spring may bear against the operating group and another end of the second spring may bear against the counter-mass. A pinion gear may be rotatably fixed to the receiver and operable to mesh with the gear rack and the second gear rack.

17 Claims, 3 Drawing Sheets

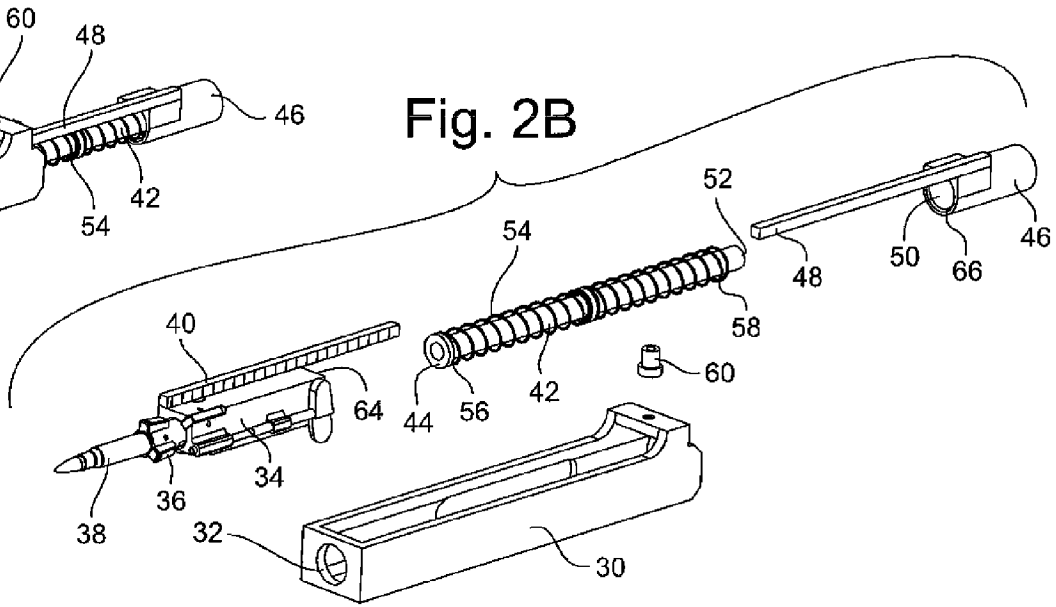
Fig. 2B
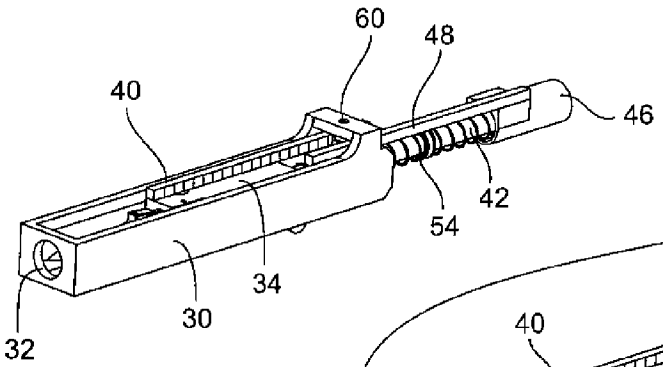
Fig. 2A
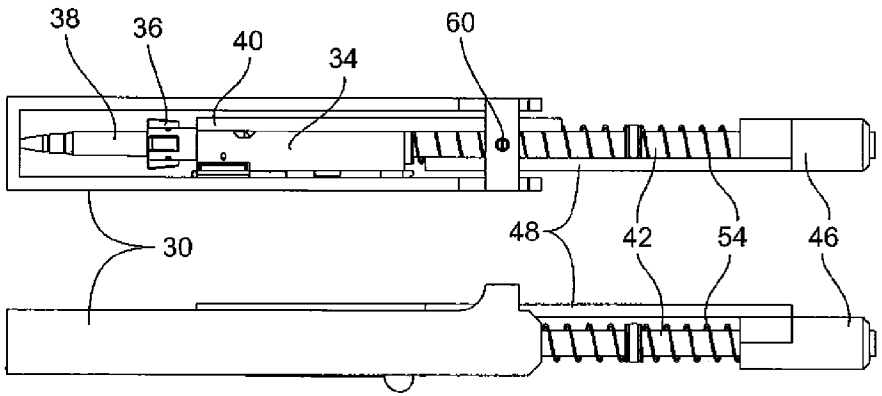
Fig. 2C
Fig. 2D

RECOIL REDUCTION APPARATUS AND METHOD FOR WEAPON

STATEMENT OF GOVERNMENT INTEREST

The inventions described herein may be manufactured, used and licensed by or for the U.S. Government for U.S. Government purposes.

CROSS-REFERENCE TO RELATED APPLICATIONS

This application is related to U.S. patent application Ser. No. 12/607,164 entitled "Apparatus and Method for Gun Recoil Mitigation," both of which have the same assignee.

BACKGROUND OF THE INVENTION

The invention relates in general to weapons and in particular to recoil reduction of weapons.

Traditional weapons may include an operating group, which may include a bolt carrier and its subcomponents, that recoils towards the user in order to cycle the weapon. Typically, the operating group may impact a surface at the end of its stroke. The impact may cause a "kick" that may be felt by the user. In some instances, many rounds of ammunition may be fired by an individual in a short period of time. The kick of the weapon may be painful or harmful to the user, particularly when using semi-automatic or automatic weapons. Many devices and methods have been used to minimize or eliminate kick. Many of these devices may not be desirable because they may add too much weight to the weapon or may be too costly.

There is a long-felt and unsolved need for an effective recoil reduction apparatus that adds little or no weight to a weapon and is relatively inexpensive. This need is particularly great for automatic and semi-automatic weapons

SUMMARY OF THE INVENTION

It is an object of the invention to provide a weapon which produces little or no kick to the user.

One aspect of the invention is a weapon that may include a housing and a receiver translatably disposed in the housing. A barrel may have one end fixed to the receiver. The barrel may be translatable with respect to the housing. A spring stop may be fixed to the barrel forward of the housing. A spring may be disposed between the spring stop and a front of the housing.

An operating group may be translatably disposed in the receiver. A gear rack may be fixed to the operating group. A longitudinal member may have one end fixed to the operating group. A counter-mass may have a second gear rack and an opening. Another end of the longitudinal member may be translatable through the opening in the counter-mass. A second spring may be disposed around the longitudinal member. One end of the second spring may bear against the operating group and another end of the second spring may bear against the counter-mass. A pinion gear may be rotatably fixed to the receiver and operable to mesh with the gear rack and the second gear rack.

The weapon may include a butt stock fixed to the housing. The butt stock may include an open area for reciprocation of the counter-mass and longitudinal member. An ammunition magazine may be removably disposed in the housing.

The operating group may include an impact surface and the counter-mass may include a second impact surface. The impact surface and the second impact surface may be operable to contact each other after firing the weapon.

Another aspect of the invention is a method of mitigating recoil in a weapon having an operating group and a counter-mass. The method may include moving the counter-mass in a direction substantially opposite a direction of movement of the operating group. The counter-mass and the operating group may be substantially coaxial. The method may include impacting the counter-mass and the operating group. The counter-mass and the operating group may move at a same speed or may move at different speeds. The operating group and the counter-mass may have substantially a same mass or may have substantially different masses.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIGS. 2A, 2B, 2C, and 2D are perspective, exploded, top and side views of a portion of the weapon of FIGS. 1A-C.

DETAILED DESCRIPTION OF THE PREFERRED EMBODIMENTS

A recoil reduction apparatus may use a rack and pinion and counter-mass system to partially or completely cancel out the rearward impulse of a weapon's operating group. The operating group of the weapon may impact a forward-moving counterweight. This impact may diminish or eliminate the "kick" produced by the operating group. Peak overall recoil forces may be reduced by coupling the recoil reduction apparatus to a recoil-translating barrel.

Figures 1A, 1B, 1C:
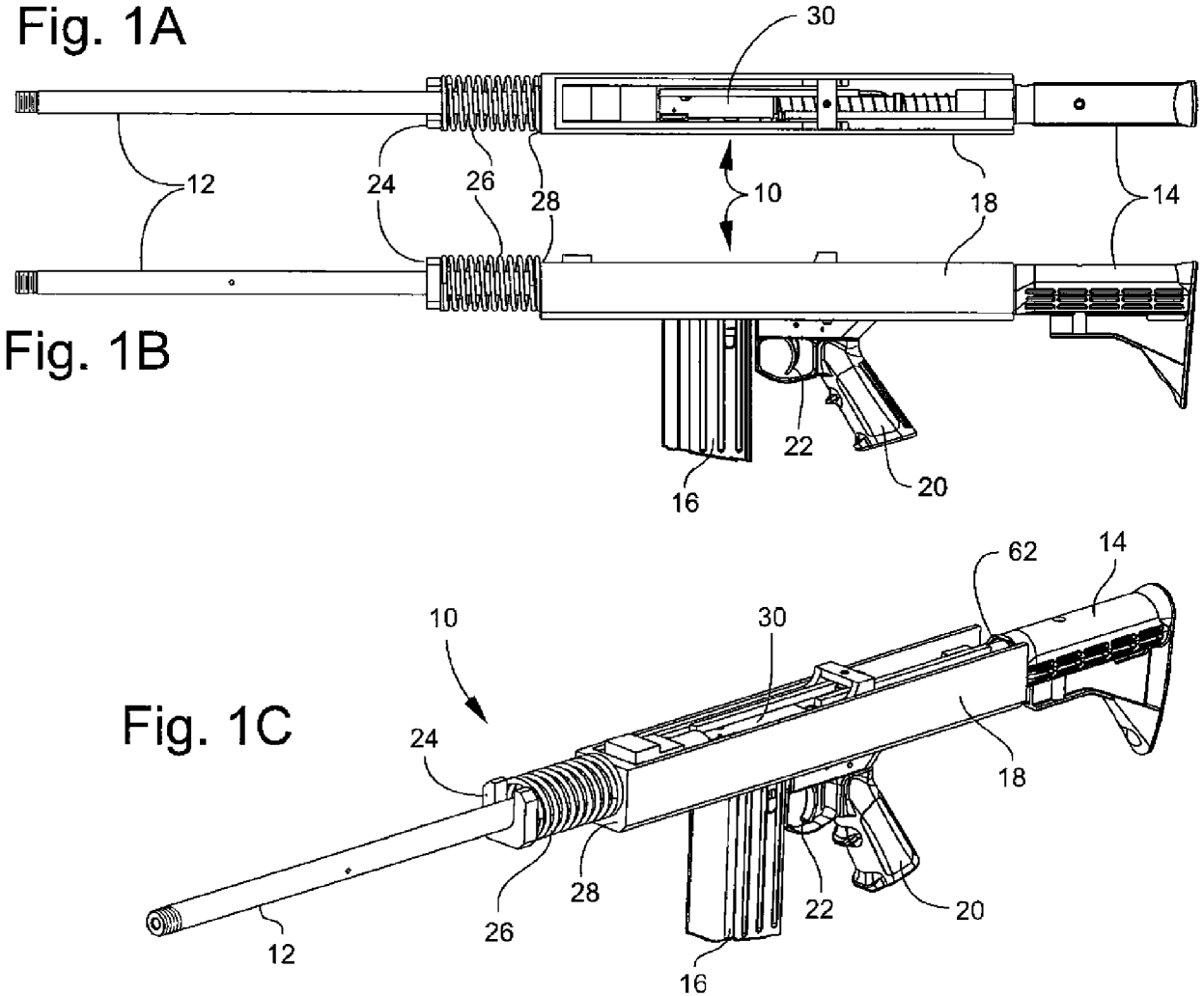
FIGS. 1A, 1B, and 1C are top, side, and perspective views, respectively, on an embodiment of a weapon in accordance with the invention.

FIGS. 1A, 1B, and 1C are top, side, and perspective views, respectively, of an embodiment of a weapon 10 in accordance with the invention. Weapon 10 may be, for example, an automatic or semi-automatic weapon of any caliber. Weapon 10 may include a barrel 12, a butt stock 14, a removable ammunition magazine 16, a housing 18, a hand grip 20, and a trigger 22. A receiver 30 may be translatably disposed in housing 18.

A barrel 12 may have one end fixed to receiver 30 at area 32 (FIGS. 2A and 2B). Barrel 12 may be translatable through an opening (not shown) in a front 28 of housing 18. A spring stop 24 may be fixed to barrel 12 at a location forward of housing 18. A compression spring 26 may be disposed between spring stop 24 and front 28 of housing 18.

FIGS. 2A, 2B, 2C, and 2D are perspective, exploded, top and side views of a portion of the weapon 10 of FIGS. 1A-C. FIGS. 2A-D show receiver 30 and associated components removed from housing 18. An operating group 34 may be translatably disposed in receiver 30. Operating group 34 may include, for example, a rotating bolt 36. An ammunition cartridge 38 may be disposed in front of bolt 36.

A gear rack 40 may be fixed to operating group 34. A longitudinal member 42 may have one end 44 (FIG. 2B) fixed to operating group 34. A counter-mass 46 may have a gear rack 48 and an opening 50. Another end 52 of longitudinal member 42 may be translatable through opening 50 in counter-mass 46. A compression spring 54 may be disposed around longitudinal member 40. One end 56 of spring 54 may bear against operating group 34 and another end 58 of spring 54 may bear against counter-mass 46. A pinion gear 60 may be rotatably fixed to receiver 30. Pinion gear 60 may be operable to mesh with gear racks 40, 48.

As seen in FIG. 1C, butt stock 14 may include an open area 62 therein for reciprocation of counter-mass 46 and longitudinal member 42. Operating group 34 may include an impact surface 64 and counter-mass 46 may include an impact surface 66. Impact surfaces 64, 66 may contact each other after firing weapon 10.

Prior to firing, the components of weapon 10 may be in the position shown in FIGS. 2A, 2C and 2D. Compression spring 54 may separate operating group 34 and counter-mass 46. Operating group 34, longitudinal member 42, compression spring 54, and counter-mass 46 may be substantially coaxial.

Figure 3:
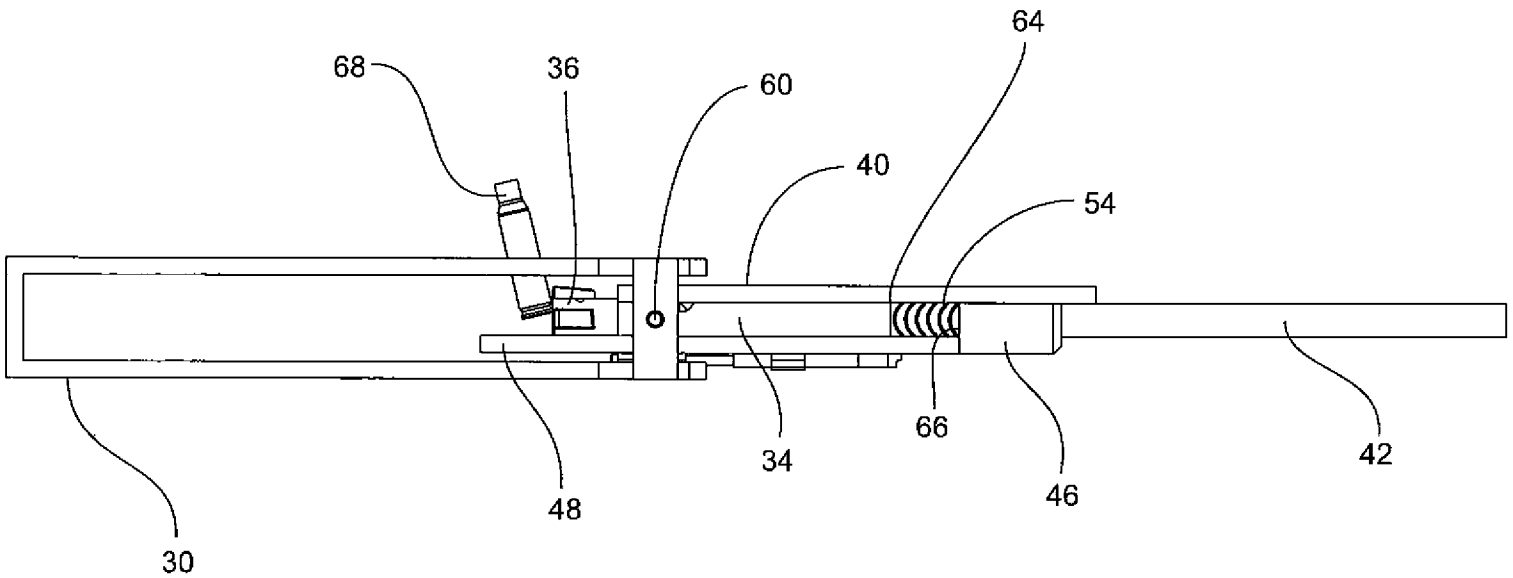
FIG. 3 is a top view, similar to FIG. 2C, after the weapon has been fired.

Upon firing, the impulse of cartridge 38 may recoil operating group 34 and operating group gear rack 40 rearward, as shown in FIG. 3. Operating group gear rack 40 may cause rotation of pinion gear 60 which may, in turn, cause forward translation of counter-mass gear rack 48 and counter-mass 46. Both operating group 34 and counter-mass 46 may compress compression spring 54. Operating group 34 and counter-mass 46 may impact at respective impact surfaces 64, 66. Impact between operating group 34 and counter-mass 46 may partially or completely cancel the rearward impulse of operating group 34. After impact between operating group 34 and counter-mass 46, compression spring 54 may cause operating group 34 and counter-mass 46 to return to their pre-firing configuration shown in FIGS. 2A, 2C, and 2D.

After firing and prior to impact of impact surfaces 64, 66, velocities of operating group 34 and counter-mass 46 may have substantially the same absolute value and opposite directions. In addition, if the mass of operating group 34 and the mass of counter-mass 46 are substantially the same, then a large amount of the recoil force may be dissipated and not felt by the user of the weapon 10. When the mass of counter-mass 46 is less than the mass of operating group 34, and, assuming equal and opposite velocities, then, less recoil force may be dissipated in weapon 10.

Momentum is the product of mass and velocity. Thus, if the velocities of operating group 34 and counter-mass 46 are opposite, but not equal, the amount of recoil dissipated in weapon 10 may be varied. In some embodiments of weapon 10, the gear ratios between pinion 60 and gear racks 40, 48 may be varied to vary the velocities of operating group 34 and counter-mass 46. Thus, the amount of recoil dissipated in weapon 10 may be varied by varying the masses and velocities of operating group 34 and counter-mass 46.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A weapon, comprising:

a housing;

a receiver translatably disposed in the housing;

a barrel having one end fixed to the receiver, the barrel being translatable with respect to the housing;

a spring stop fixed to the barrel forward of the housing;

a spring disposed between the spring stop and a front of the housing;

an operating group translatably disposed in the receiver;

a gear rack fixed to the operating group;

a longitudinal member having one end fixed to the operating group;

a counter-mass having a second gear rack and an opening, another end of the longitudinal member being translatable through the opening in the counter-mass;

a second spring disposed around the longitudinal member, one end of the second spring bearing against the operating group and another end of the second spring bearing against the counter-mass; and a pinion gear rotatably fixed to the receiver and operable to mesh with the gear rack and the second gear rack.

2. The weapon of claim 1, further comprising a butt stock fixed to the housing and including an open area for reciprocation of the counter-mass and longitudinal member.

3. The weapon of claim 1, further comprising an ammunition magazine removably disposed in the housing.

4. The weapon of claim 1, wherein the operating group includes an impact surface and the counter-mass includes a second impact surface, the impact surface and the second impact surface being operable to contact each other after firing the weapon.

5. The weapon of claim 1, wherein the weapon is an automatic weapon.

6. The weapon of claim 1, wherein the weapon is a semi-automatic weapon.

7. The weapon of claim 1, wherein the operating group and the counter-mass have substantially a same mass.

8. The weapon of claim 1, wherein the operating group, longitudinal member, second spring, and counter-mass are coaxial.

9. The weapon of claim 1, wherein the operating group and the counter-mass have substantially a different mass.

10. A method of mitigating recoil in the weapon of claim 1, comprising moving the counter-mass in a direction substantially opposite a direction of movement of the operating group, wherein the counter-mass and the operating group are substantially coaxial.

11. The method of claim 10, further comprising impacting the counter-mass and the operating group.

12. The method of claim 10, wherein the counter-mass and the operating group move at a same speed.

13. The method of claim 10, wherein the counter-mass and the operating group move at different speeds.

14. The method of claim 10, wherein the weapon is an automatic weapon.

15. The method of claim 10, wherein the weapon is a semi-automatic weapon.

16. The method of claim 10, wherein the operating group and the counter-mass have substantially a same mass.

17. The method of claim 10, wherein the operating group and the counter-mass have substantially different masses.

* * * * *